United States Patent [19]

Todokoro

[11] 4,149,725

[45] Apr. 17, 1979

[54] GAME BOARD HAVING ANIMATED BALL PROJECTORS WITH RETRACTING HOODS AND CENTRAL TARGET

[76] Inventor: Masatoshi Todokoro, 33-2-2 Koganehara, Matsudo-shi, Chiba-ken, Japan

[21] Appl. No.: 842,222

[22] Filed: Oct. 14, 1977

[30] Foreign Application Priority Data

Apr. 23, 1977 [JP] Japan ..... 52-51684[U]

[51] Int. Cl.[2] ..... A63B 63/02; A63F 7/00

[52] U.S. Cl. ..... 273/101; 46/145; 46/123; 124/4

[58] Field of Search ..... 273/101, 129 GA, 121 E; 124/79, 5, 4; 46/145

[56] References Cited

U.S. PATENT DOCUMENTS

| | | | |
|---|---|---|---|
| 1,539,648 | 5/1925 | Chester et al. | 273/101 |
| 2,480,030 | 8/1949 | Karwacki | 46/145 |
| 2,606,394 | 8/1952 | Janiak | 124/79 |
| 2,611,997 | 9/1952 | Solloway et al. | 46/145 |
| 3,269,055 | 8/1966 | Gordon | 46/145 |
| 3,481,605 | 12/1969 | Giraurd et al. | 46/145 |

FOREIGN PATENT DOCUMENTS

| | | | |
|---|---|---|---|
| 1044204 | 11/1953 | France | 273/101 |
| 1427794 | 3/1976 | United Kingdom | 273/121 E |

OTHER PUBLICATIONS

Mr. Mouth, Ref. from Tomy 1976 Catalog, p. 15.

*Primary Examiner*—Richard J. Johnson
*Assistant Examiner*—Lawrence E. Anderson
*Attorney, Agent, or Firm*—George B. Oujevolk

[57] ABSTRACT

A ball game board for children comprising a base board, a ball receiver having a ball receiving pit, said ball receiver being provided in the center of the board for receiving the ball directed thereto, and ball shoot-out units modelled after an animal or otherwise configured for promoting the sense of amusement and arranged at suitable locations along the periphery of the board, each of said ball shoot-out units having a ball shoot-out port designed to be opened and closed by a hood member, a chute along which the ball is shot out toward the ball receiver at the center of the board from said shoot-out port, a lever adapted to actuate a ball shooter provided below said chute, a control bar connected between said lever and said hood member for letting said hood member move from its closed position to its open position when the ball shooter is actuated by said lever, and a channel-like ball passage along which the ball is guided down to said ball shooter.

5 Claims, 12 Drawing Figures

GAME BOARD HAVING ANIMATED BALL PROJECTORS WITH RETRACTING HOODS AND CENTRAL TARGET

This invention is to provide a ball pit-in game board designed for play by children in which when each player operates a lever adapted to each ball shoot-out unit modelled after an animal or otherwise configured and arranged along the periphery of the base board, an opening likened to the animal's mouth is opened and the ball is shot out therefrom toward the pit provided in the center of the board and whereby children can compete with each other for pit-in or hole-in of the ball while enjoying the amusingness of the movement of each ball shoot-out unit.

The invention is now described in detail with reference to the accompanying drawings, in which:

FIGS. 1 to 8 show an embodiment of this invention, where

Figure 1:
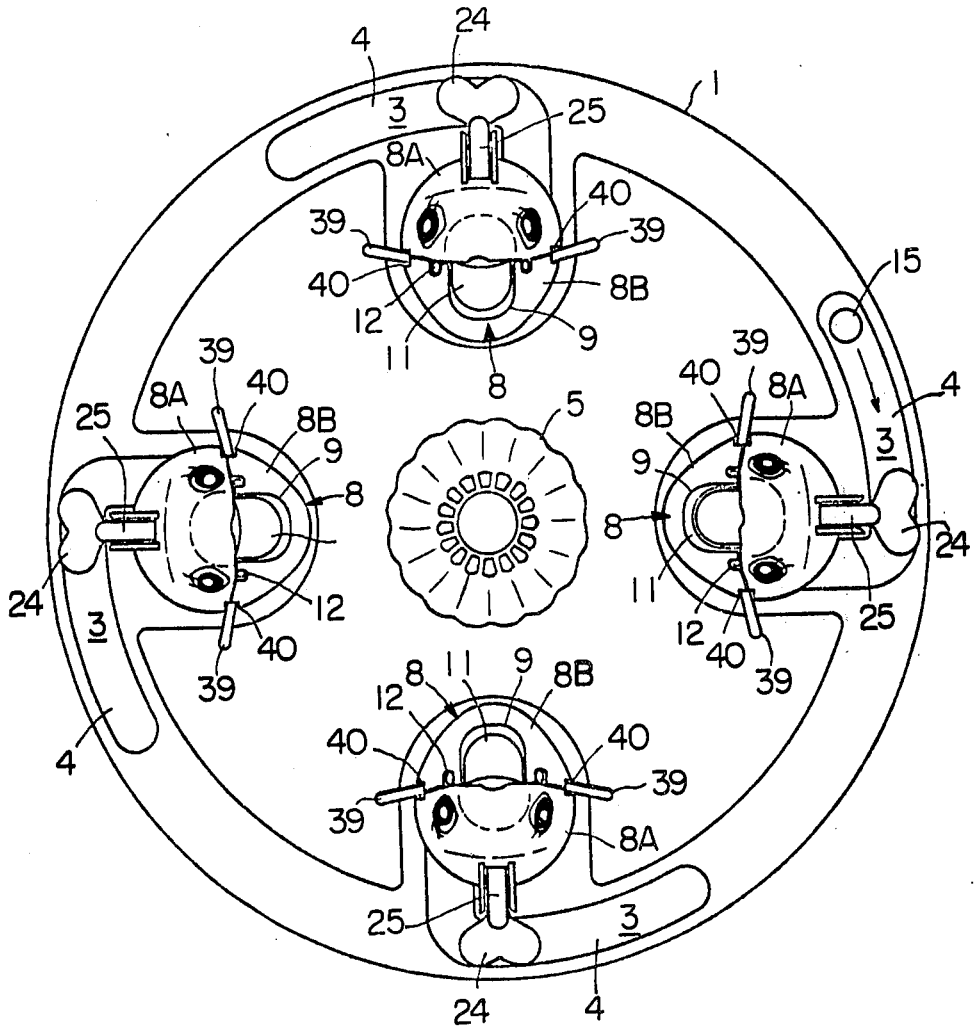
Figure 2:
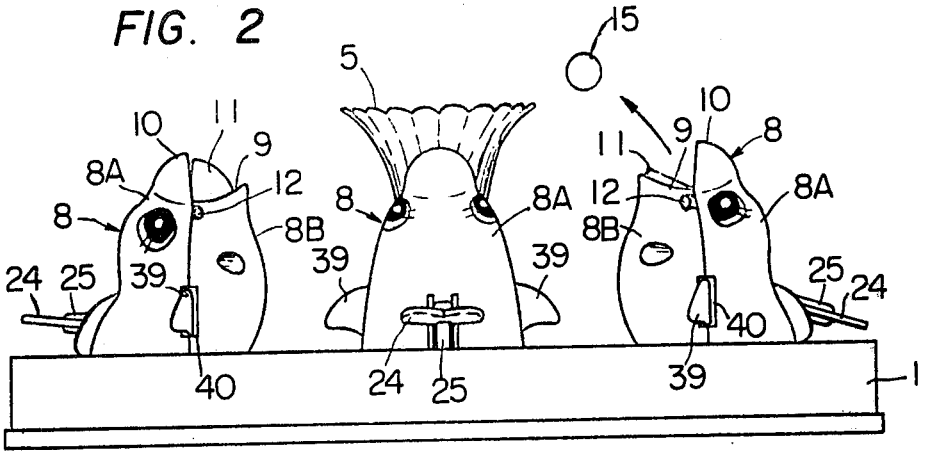
Figure 3:
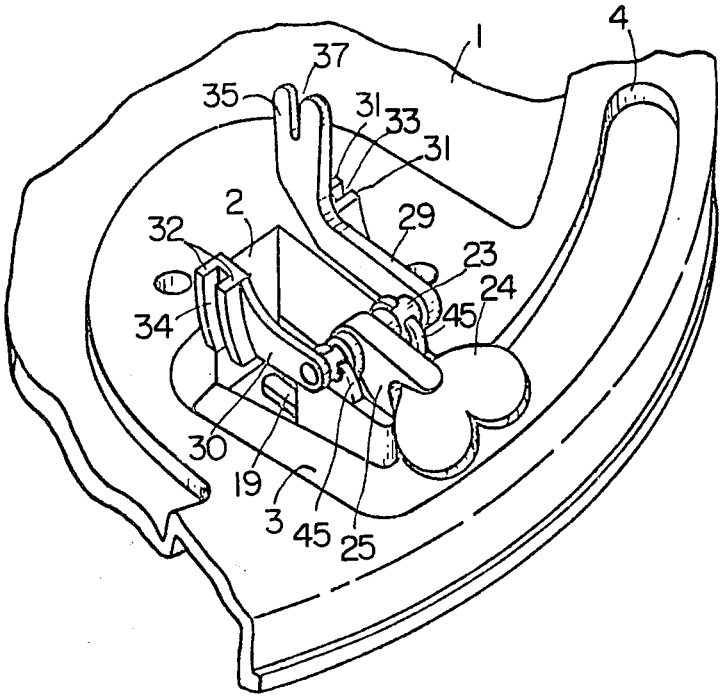
Figure 4:
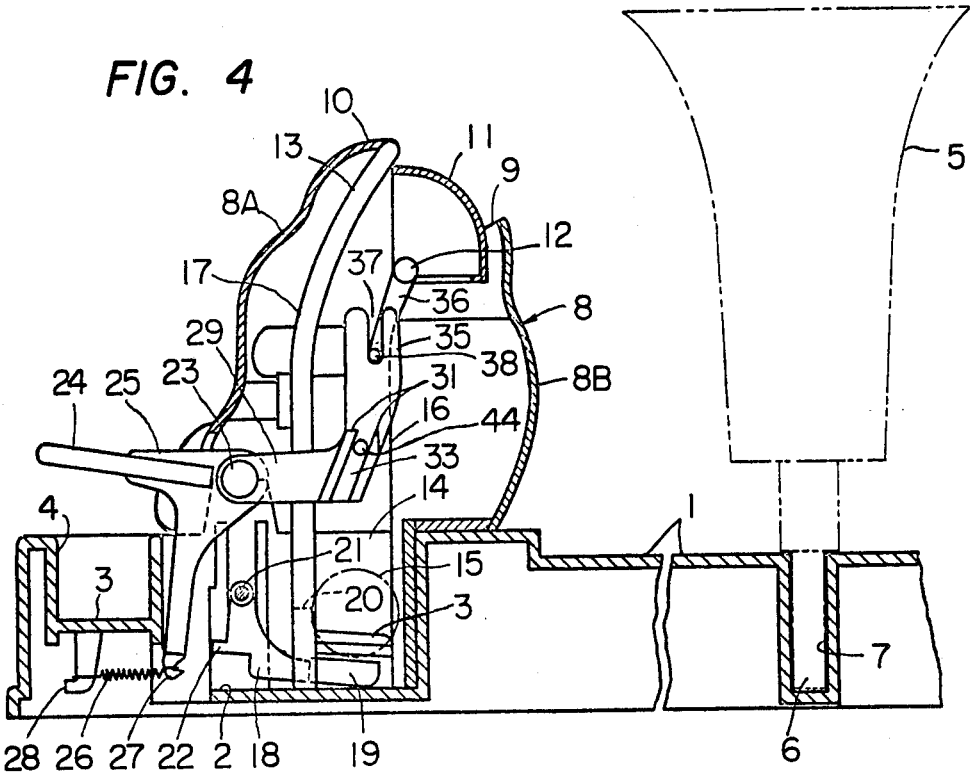
Figure 5:
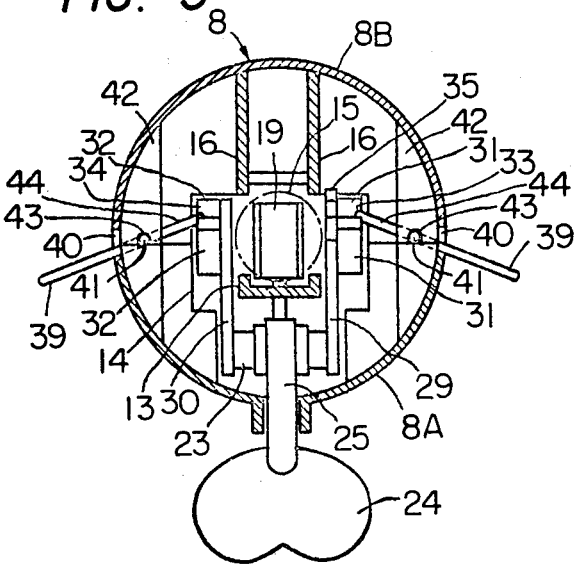
Figure 6:
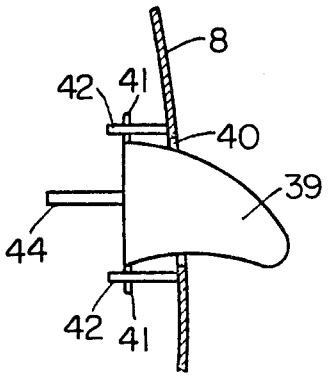
Figure 7:
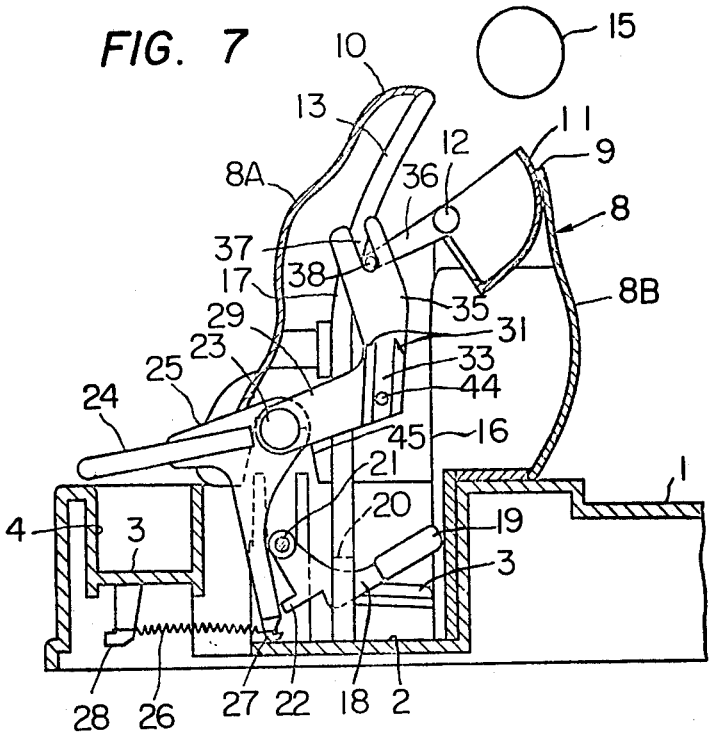
Figure 8:
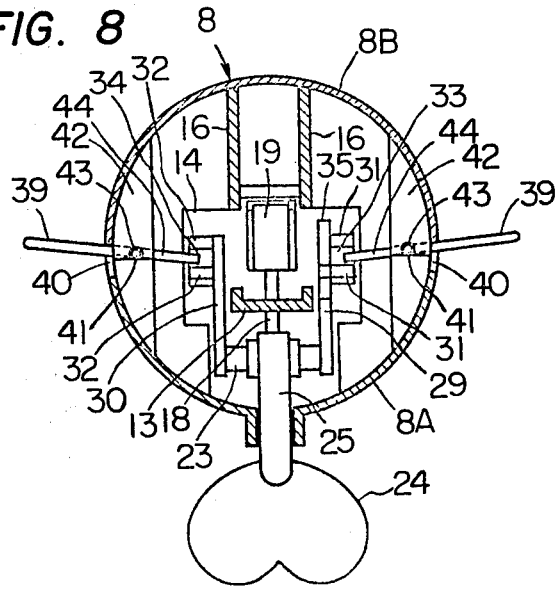
Figure 9:
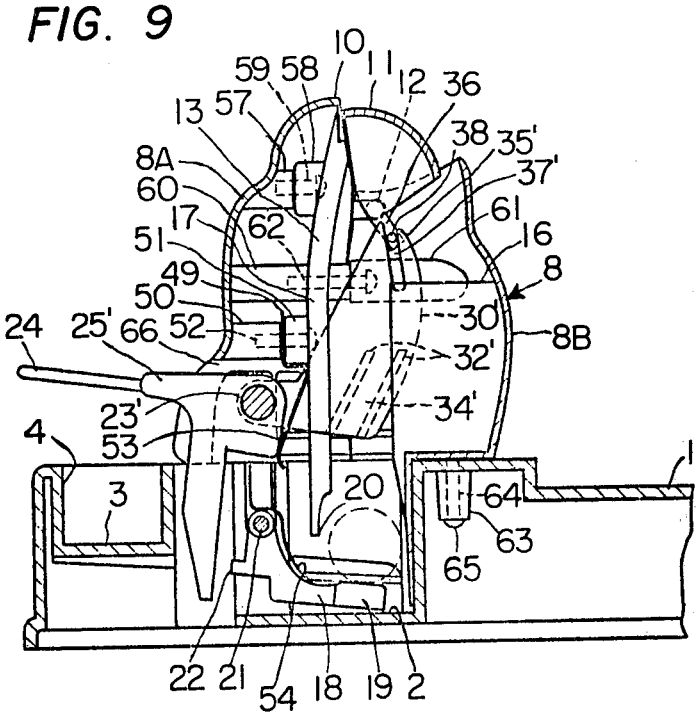
Figure 10:
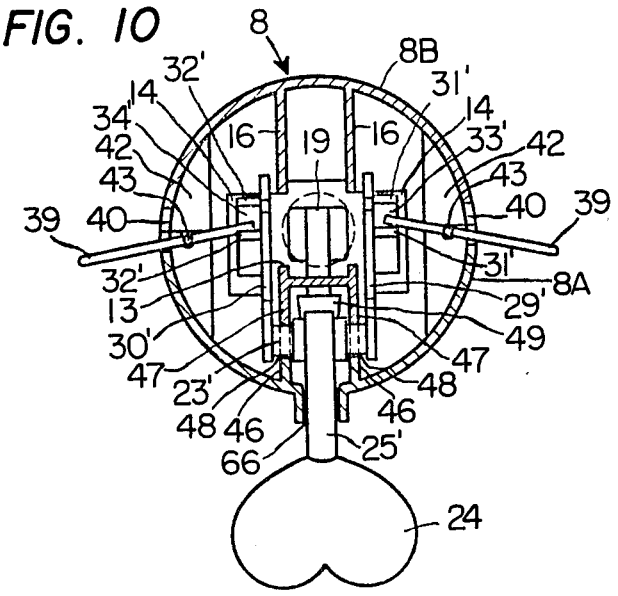
Figure 11:
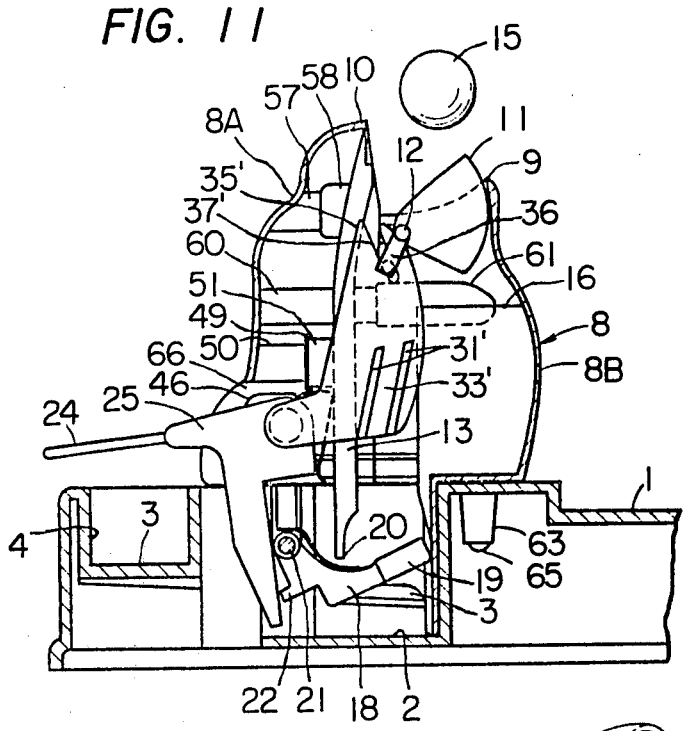
Figure 12:
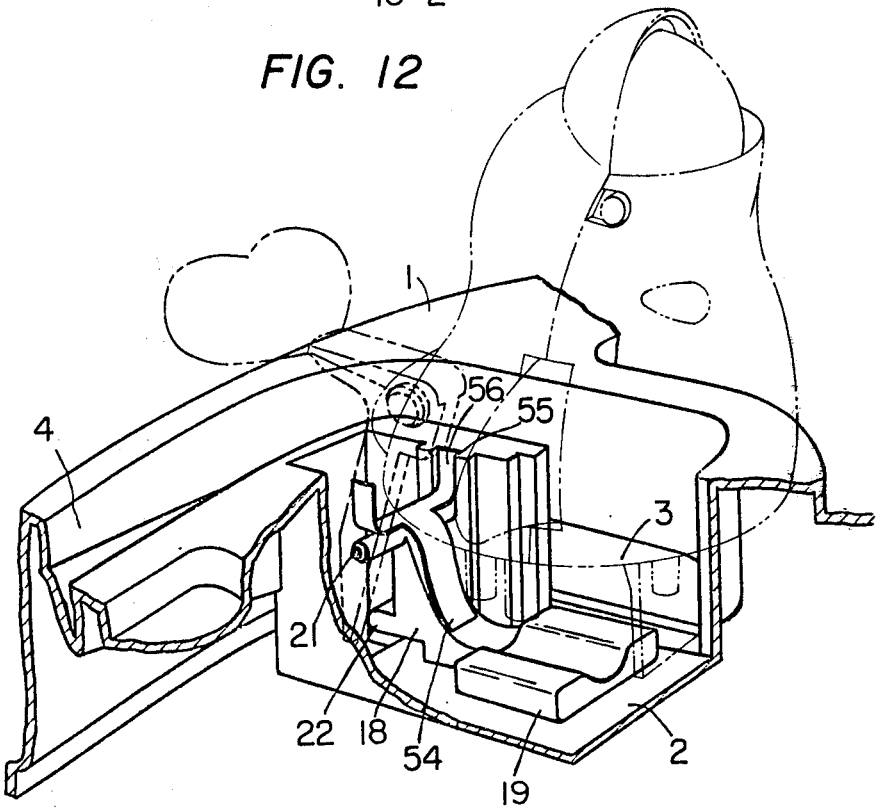

FIG. 1 is a top plan view of a ball pit-in game board according to this invention, FIG. 2 is a side view thereof, FIG. 3 is a perspective view of a ball shoot-out unit, with parts removed away, FIG. 4 is a partial enlarged longitudinal sectional view of a hood member in its closed position, FIG. 5 is a partial cross-sectional view thereof, FIG. 6 shows a fin as mounted in position, FIG. 7 is a partial enlarged longitudinal sectional view of the hood member as it was opened out, and FIG. 8 is a partial cross-sectional view thereof; and FIGS. 9 to 12 show another embodiment of this invention incorporating partial modifications of the embodiment of FIGS. 1 to 8, where FIG. 9 is a partial enlarged longitudinal sectional view of the hood member in its closed position, FIG. 10 is a partial cross-sectional view thereof, FIG. 11 is a partial enlarged longitudinal sectional view of the hood member in its open position, and FIG. 12 is a partial perspective view of a ball shoot-out unit.

Referring first to FIGS. 1 to 8 illustrating diagrammatically an embodiment of this invention, there is provided a circular base board 1 having a suitable height and provided along its peripheral edge with four equally spaced channel-like ball passages 4 each of which comprises a recession 2 and a slant bottom portion 3 designed to allow each ball to roll down from a place suitably spaced from said recession 2 toward a place in said recession 2 positioned closest to the center of the board. At the center of the base board is disposed a ball receiver 5 having a shape like a shuttlecock used in badminton. This ball receiver 5 is removably set in position by inserting a support rod 6 provided at its bottom into a corresponding hole 7 formed in the center of the board. Mounted fixedly over each said recession 2 is a hollow ball shoot-out structure 8 having the configuration of an upwardly facing dolphin and assembled from two divided sections, or back side section 8A and belly side section 8B. The external surfaces of these structures may be suitably colored. For instance, they may be colored commonly in white on the belly side 8B while colored in different colors on the back side 8A. At the top of each said structure 8 is provided a ball shoot-out port 9. This port 9 is provided so as to be openable and closable by pivotally joining (at 12) a hood member 11 modelled after the lower jaw of the dolphin to the proximal end of the portion 10 corresponding to the upper jaw of the dolphin. Also provided in each of said structure 8 is a trajectory chute 13 extending from the inside end of the upper jaw 10 of the mouth 9 to the bottom of the recession 2 through an opening 14 provided at the bottom portion of said structure 8. This trajectory chute 13 is designed to guide the ball 15 so that it is shot out from the inside of the structure 8 toward the ball receiver 5 from the port 9 (dolphin mouth). Said chute is provided with support plates 16 adapted such that the ball 15 won't come off the trajectory in its course of movement from the lower end of the chute 13 to its intermediate curved portion 17. Provided in each said recession 2 is a ball shooter 18 which is pivotally secured at 21 such that its ball receiving portion 19 projects out from the rear side of the chute 13 to its front side through a cutout 20 formed in the lower part of said chute 13. Said shooter 18 also has a protuberance 22 on the opposite side of the ball receiving portion 19. Passed transversely above each said recession 2 is a shaft 23 whose both ends are supported by protuberant bearing portions 45, 45 formed integral with the upper edge of said recession 2 positioned close to the periphery of the base board 1. Joined integrally to the middle part of said shaft 23 is a lever 25 of which one end is inserted into a position opposed to the protuberance 22 of the shooter 18 in the recession 2 while the other end projects out from an opening 66 formed in the part corresponding to the dorsal fin of the dolphin and is provided with an end plate 24 shaped after the dolphin tail. A coil spring 26 is disposed between the hooked end 27 of the lever 25 and a protuberance 28 from the lowerside of the bottom portion 3 of the channel 4 in the base board 1, whereby the lever 25 is always urged away from the shooter 18. Extending from both ends of the shaft 23 in parallel relation to each other are arm bars 29 and 30 each of which has provided on the external side of its distal end a pair of curved ridges 31, 31 (32, 32) with a space 33 (34) defined therebetween. An end of one of said arm bars 29 is bent upwards orthogonally and extended, with its end terminating into a forked control bar 35. There is also provided a connecting rod 36 having its one end fixed to the shaft 12 of the hood member 11 and having its other end fixed to a pin 38 fitted in the recess 37 in said forked control bar 35, whereby when the ball shooter 18 is actuated by the lever 25, the hood member 11 is moved from its closed position to the open position by the control bar 35. Fin-like plates 39, 39 copied from the dolphin fins are extended out from the openings 40 formed in both sides of the shoot-out structure 8. The lobes 41, 41 provided at both upper and lower ends of each said fin plate 39 placed inside the structure 8 are passed through the corresponding holes 43, 43 in the support plates 42, 42 extending from the inside wall of the structure 8 such that each said fin plate 39 is vibratable. Extending inwardly from the middle part of the bottom edge of each said fin plate 39 is an elongated protuberance 44 whose end is fitted into the space 33 (34) between the curved ridges 31, 31 (32, 32) provided on the corresponding arm bar 29 (30).

Now, the operation of the above-described mechanism of the ball pit-in game board according to this invention is discussed. First, a ball 15 is put into the channel 4 so that said ball rolls down by itself onto the ball receiving portion 19 of the shooter 18, and then the player jerks down the end plate 24 of the lever 25, whereby the end of the lever 25 placed in the recession 2 hits against the protuberance 22 of the shooter 18 against the elastic force of the spring 26 as shown in FIG. 7 and the ball receiving portion 19 is sprung up to shoot up the ball 15. The arm bars 29, 30 and control bar 35 are also jerked up about the shaft 23 to raise up the connecting rod 36 about the shaft 12 to let the hood member 11 move from its closed position of FIG. 4 to its open position of FIG. 7, thereby opening the ball shoot-out port 9. The shot-up ball 15 is guided along the chute 13 and flies out from said port 9 toward the pitted ball receiver 5. If the ball is properly shot, it will directly dive into the ball receiver 5, but if the ball is improperly shot, it will fall off the ball receiver 5.

The end plate 24 of the lever 25 is brought into a no-loaded condition immediately after shooting of the ball 15, so that the end of the lever 25 placed in the recession 2 is forced back to its original position shown in FIG. 4 under the elastic force of the spring 26. This also returns the ball shooter 18 as well as the arm bars 29, 30 and control bar 35 to their original positions and the connecting rod 36 is lowered down to let the hood member 11 move from its open position of FIG. 7 to its closed position of FIG. 4, thereby closing the ball shoot-out port 9.

It is to be noted here that when the arm bars 29, 30 are jerked up, the curved ridges 31, 31 and 32, 32 are turned about the shaft 23 from the position of FIG. 4 to the position of FIG. 7, causing the protuberances 44, 44 of the respective fin plates 39, 39 to turn about the lobes from the position of FIG. 5 to the position of FIG. 8, while when the raised-up arm bars 29, 30 are returned to their original positions, the curved ridges 31, 31 and 32, 32 turn from the position of FIG. 7 to the position of FIG. 4, causing the protuberances 44, 44 of the respective fin plates 39, 39 to turn about the lobes 41, 41 from the position of FIG. 8 to the position of FIG. 5, so that the portions of the fin plates 39, 39 extending outside of the structure 8 are vibrated to-and-fro.

Referring now to FIGS. 9 to 12 of the accompanying drawings, there is shown another embodiment of this invention which is a partially modified version of the above-described embodiment. In this modified embodiment, a pair of protuberances 46, 46 extending from the inside of the back side portion 8A of the shoot-out structure 8 with the opening 66 being flanked thereby are arranged in abutment against the corresponding pair of protuberances 47, 47 extending from the rear side of the trajectory chute 13, said protuberances 46, 46 being provided with bearing holes 48, 48 opening in the abutting edges, and a shaft 23′ similar to the shaft 23 in the proceding embodiment is supported at its both ends in said bearing holes 48, 48. Also, a lever 25′ similar to the lever 25 of the foregoing embodiment is joined to the middle part of said shaft 23′. There is provided a leaf spring 49 which has its one end held between the abutting portions of a protuberance 50 extending from the inside middle part of the back side portion 8A of the shoot-out structure 8 and another corresponding protuberance 51 extending from rear side of the chute 13 and is fixed by a screw 52 screwed through the protuberance 51 into the protuberance 50 for securing the middle portion of the chute 13 in position. The other end of said leaf spring 49 is pressed against an angular portion 53 of the lever 25′ positioned beneath the shaft 23′ to always urge the lever 25′ away from the shooter 18. Extending from both ends of the shaft 23′ toward the ball shoot-out port 9 of the structure 8 and in parallel relation to each other are a pair of arm bars 29′ and 30′ which have provided on their external sides the paired slant ridges 31′, 31′ and 32′, 32′, with the spaces 33′ and 34′ being defined therebetween, and the protuberances 44, 44 of the respective fin plates 39, 39 are fitted in said respective spaces 33′, 34′. Also, the upper ends of said respective arm bars 29′, 30′ terminate into the bifurcated control bars 35′, 35′, and pins 38, 38 are fitted separately in the recesses 37′, 37′ in said respective control bars 35′, 35′, said pins 38, 38 being connected to both ends of the pivotting shaft 12 of the hood member 11. A leaf spring 54 is provided to always press the ball receiving portion 19 of the ball shooter 18 against the bottom of the recession 2. The upper end of said leaf spring 54 is joined integral to a U-shaped fixture 56 fitted in the grooves 55 where both ends of the pivotting shaft 21 of the shooter 18 are also engaged, while the lower end of said leaf spring is pressed against the upper side of the proximal end of the ball receiving portion 19. Extending from the inside of an upper part of the back side portion 8A of the shoot-out structure 8 is a protuberance 57 which abuts to a corresponding protuberance 58 extending from the rear side of the chute 13, and a screw 59 is screwed into said both protuberances from the protuberance 58 side to secure the upper portion of the chute 13. Also extending from the inside of the back side portion 8A of the structure 8 is a protuberance 60 which is positioned intermediate said protuberances 50 and 57 and in abutment against a corresponding protuberance 61 extending from the inside of the belly side portion 8B of said structure 8, and a screw 62 is passed therethrough from the protuberance 61 side to thereby securely join the back side and belly side portions 8A and 8B of the shoot-out structure 8. 63 is a hollow protuberance extending from the underside of the base board 1, and an engaging protuberance 64 extending from the bottom of the structure 8 is fitted into the central hole in said protuberance 63, with a screw 65 being screwed thereinto to secure said structure 8 to the base board 1.

In this embodiment, when the player jerks down the end plate 24 of the lever 25′, the end of the lever 25′ placed inside the recession 2 is forced out to strike against the protuberance 22 of the shooter 18 against the elastic force of the leaf spring 49 as shown in FIG. 11, whereby the ball receiving portion 19 is brought up against the force of leaf spring 54 to drive out the ball 15. The arm bars 29′, 30′ and control bars 35′, 35′ are also tugged up about the shaft 23′ to raise up the connecting rods 36, 36 about the shaft 12 to open the hood member 11, allowing the ball 15 driven up along the chute 13 to fly out from the port 9 toward the ball receiver 5.

As the end plate 24 of the lever 25′ is brought into a no-load condition immediately after shoot-out of the ball 15, the end of the lever 25′ in the recession 2 is forced away from the protuberance 22 of the ball shooter 18 to return to its original position under the elastic force of the leaf spring 49. Also, the shooter 18 as well as the arm bars 29′, 30′ and control bars 35′, 35′ are forced back to their original by the action of the leaf spring 54, and the connecting rods 36, 36 are lowered down to close the hood member 11.

When the hood member 11 is opened or closed, the fin plates 39, 39 are also actuated in the similar way to the preceding embodiment to vibrate to-and-fro.

According to this embodiment, all the component parts except for the ball shooter 18 can be incorporated in the shoot-out structure 8, so that assemblage of said structure 8 and its securing to the base board 1 are even more facilitated. Also, since the ball shooter 18 is quickly and accurately returned to its original position by the elastic force of the leaf spring 54, continuous shooting of the balls 15 causes no delay in the operation of the shooter 18 and hence no mis-shoot is committed.

In use of the game board of this invention, it is advisable to use the balls of different colors for the respective shoot-out units 8 because if the balls shot out from the respective shoot-out units 8 are all same in color, confusion will be raised in judging the player who has successively shot the ball into the ball receiver 5.

Although the shoot-out structures used in the above-described embodiments of this invention are modelled after dolphin, it is possible to give any other desired shape to said structures, and in such case, it is advisable to shape each hood member in imitation of an animal body portion which makes a peculiar movement, and to provide the operating parts capable of reproducing such peculiar movements with opening of the hood member.

As described above, there is provided according to this invention a very joyful play board in which when a lever is jerked down, a dolphin-shaped structure opens its mouth and a ball flies out therefrom toward the ball receiver, and upon closure of the mouth, the fins vibrate to-and-fro, so that the children can enjoy the ball pit-in game while amused by the jolly movements of the ball shoot-out structures.

What is claimed is:

1. In a game board for a game of placing balls in a pit, comprising:

(a) a base board (1) with a peripheral edge;

(b) a ball receiver (5) provided at the center of said board (1);

(c) ball shoot-out structures (8) patterned after the body of an up-facing dolphin arranged along said peripheral edge, each of said ball shoot-out structures (8) having at its top a ball shoot-out port (9);

(d) a hood member (11) designed to be closed and opened, disposed over said shoot-out port (9), a trajectory chute (13) along which the ball is guided through the interior of the shoot-out structure (8) so as to fly out from said port (9) toward said ball receiver (5);

(e) a lever (25) provided below said chute (13);

(f) a ball shooter (18) actuated by said lever, a control bar connected between said lever and said hood member (11) for having said hood member (11) move from its closed position to an open position when the ball shooter is actuated by said lever; and, (g) a ball passage (4) for guiding the ball to the ball shooter, the improvement therein wherein, (h) each of said structures modeled after an up-facing dolphin has provided therein a hood member assuming the shape of the dolphin mouth, said lever being shaped like a dolphin tail, fin plates modeled after the dolphin fins, the control bar being coupled to open and close said hood member having engaging means for vibrating said fin plates.

2. The ball game board as set forth in claim 1, wherein a recession and a ball passage with a bottom slanted to let a ball roll down into said recession provided at least at one place along the periphery of the board, with a ball shooter being disposed in each of said recessions and said ball shoot-out structure disposed over each said recession.

3. The ball game board as set forth in claim 2, said lever having a pivotal shaft wherein arm bars with external sides extend parallel to each other from both ends of said pivotal shaft and are provided on said external side with two slant ridges, protuberances extending from the respective fin plates into the ball shoot-out structure disposed in the spaced defined by said ridges, and at least one of said arm bars having a control bar for effecting the opening and closing of said hood member.

4. The ball game board as set forth in claim 3 wherein each said ball shooter is mounted with spring so coupled as to return said shooter back to its original position after it has been sprung up by the lever.

5. The ball game board as set forth in claim 4 including a bearing portion on the inner wall of each ball shoot-out structure, said lever being pivotally supported to said bearing portion and the pivotal shaft is provided with an angular portion with a spring, said spring normally urging said lever away from the ball shooter.

* * * * *